United States Patent [19]

Kramert

[11] Patent Number: 4,557,250

[45] Date of Patent: Dec. 10, 1985

[54] FIREBOX FOR BURNING SOLID FUELS CLEANLY

[76] Inventor: Arthur R. Kramert, 1410 Del Rio Rd., Roseburg, Oreg. 97470

[21] Appl. No.: 557,479

[22] Filed: Dec. 2, 1983

[51] Int. Cl.[4] ..... F24B 1/28

[52] U.S. Cl. ..... 126/125; 126/121; 126/120; 110/210

[58] Field of Search ..... 110/345, 341, 344, 346, 110/347, 235, 242, 243, 244, 248; 126/121, 120, 125

[56] References Cited

U.S. PATENT DOCUMENTS 4,334,484 6/1982 Payne et al. ..... 110/210
4,395,956 8/1983 Hand, Jr. et al. ..... 110/210
4,419,942 12/1983 Johnson ..... 110/210
4,422,437 12/1983 Hirschey ..... 110/210

*Primary Examiner*—Henry C. Yuen

[57] ABSTRACT

A firebox for burning solid fuels which avoids common problems causing pollution and poor efficiency, by methods to ensure that the firebox is hot, to provide hot combustion air, to exploit radiant heat effects, by focusing surfaces, by burning heated secondary air on the face of a reactor. The reactor also serves to meter secondary air to suit fire size. The firebox per se is not a complete stove; it requires the addition of a heat exchanger which may be to air or hydronic, integral or remote, and which in turn is amenable to variations in design.

2 Claims, 6 Drawing Figures

FIREBOX FOR BURNING SOLID FUELS CLEANLY

BACKGROUND OF THE INVENTION

1. Field of the Invention

This invention provides means for cleaner, more efficient and rational combustion when burning wood, bio-mass or oil-shale by hand firing. It is not suitable for burning coal.

2. Description of the Prior Art

Because almost any arrangement will permit a fire to burn this is a crowded field where stoves are legion. Prior art is replete with examples where whim and witchcraft have created inadequate designs.

The generalizations which follow are intended to illumine problems which have not been identified nor adequately attacked.

Conventional stoves work at cross-purposes. Extracting heat from a firebox hinders the combustion process. When the walls of a firebox are not hot, flames and gases wiping them are quenched and the propagation of combustion stops. Catalytic burners, and their shortcomings are well known; their usage is indicative of a lack of inquiry as to *why* gases are unburned.

Conventional stoves neglect the powerful potential in the use of radiant heat. Air and gases are transparent to the radiant heat of fire and firebox walls and to assume that combustion air will be heated by squirting it into the fire is faulty. Air will then only be heated by diluting it with gases and the gases only cooled by diluting them with air.

Conventional stoves admit air to the firebox as a coherent stream or streams and hope that turbulence will mix the air with hot gases. At low fires, for example, there is no turbulence and mixing is particularly inadequate. To the degree that air does not contact the fuel and mix well with the gases, it fails to take part in combustion. It goes thru the firebox and up the stack for a ride. It is parasitic.

Conventional stoves make no use of the fact that surfaces with good emissivity (black) when heated by radiant heat, will act as does a mirror with light, to reradiate that heat. As with light, we can focus that heat. Shaping surfaces with the deliberate objective of focusing that radiant heat on fuel seems to be ignored.

Conventional stoves, using manual firing, have a cyclic change in the burning rate unless adjustments are somehow made. It is impractical to chain a little devil to the stove to read $CO_2$ and adjust secondary air supplies. Likewise impractical, is an oxygen analyzer/controller—too costly. Insufficient air wastes unburned gases and smokes; too much is parasitic.

Conventional stoves have not borrowed from the old technique of making infrared or radiant heat burners which admit gas thru many ceramic ports and burn in tiny flamelets on the surface of the ceramic. This needs only to be reversed by bringing air thru a bed and bringing gases to the face.

This is indicative of the problems in Prior Art which this invention deals with.

SUMMARY OF THE INVENTION

It is the object of this invention to devise arrangements methods and means, co-acting to provide clean and efficient burning. It does so by:

a. Divorcing the firebox completely from the subsequent exchange of heat to air or water, in order to keep interior walls hot.

b. Insulating the exterior of the firebox or wrapping the firebox in exiting hot gases to keep interior walls hot.

c. Shaping the hot surfaces so they are normal to the fire, thus "see" the heat source. This is so that they be heated by radiant heat and in turn serve as emitters to re-radiate back to the fire.

d. Providing only minimal primary air for a lean mixture, preheating it as is usual but preheating it both externally of a firebox endwall and then further spreading it in two thin sheets to wipe the interior of the firebox and be heated further. Point to be made—the air wipes the inner radiant heated face of the metal and no conduction thru the metal wall is required.

e. Admitting heated secondary air thru a reactor bed which in turn has several functions:

1. To burn gas and particulates at its face.
2. To receive and reradiate radiant heat.
3. To automatically meter the secondary air in ratio to draft changes. This reactor bed is not catalyst coated; it is of ceramic fibers supported on stainless screen held in a stainless box.

e. Scaling the firebox to the fuel to be fired rather than notions of how much outside area is needed to heat a space. Sizing comes into play in that a small fire radiating to walls raises the heat of those walls inversely as the square of the distance. So that as the firebox volume increases the rate of heat evolution for the same wall temperature must be at least equal to the rate of heat loss from the firebox.

BRIEF DESCRIPTION OF THE DRAWINGS

FIG. 1 shows four lengths of 6" smokepipe in parallel going from the firebox to smokebox 15 and there collecting into one smokepipe. This exchanger arrangement is crude, but was actually used to prove out a prototype firebox by making a complete stove. The sides of the stove use stainless sheets slipped into tracks to serve as a convector discharging close to the ceiling.

FIG. 2 shows a basic firebox set into a existing fireplace opening and the waste gases routed to an exchanger placed at the apex of the chimney. This exchanger circulates liquid, and incidentally is the subject of recently granted U.S. Pat. No. 4,449,571 titled "Heat Recovery System".

BEST MODE FOR CARRYING OUT THE INVENTION

Figure 1:
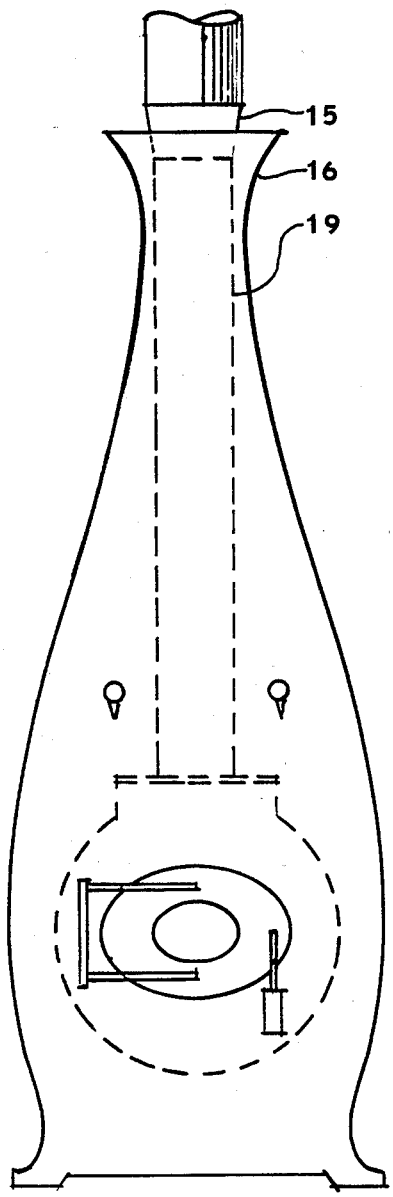
FIG. 1 and FIG. 2 show that the basic firebox can be used—in fact must be used—with a secondary heat exchanger through which the waste gases are run.
Figure 2:
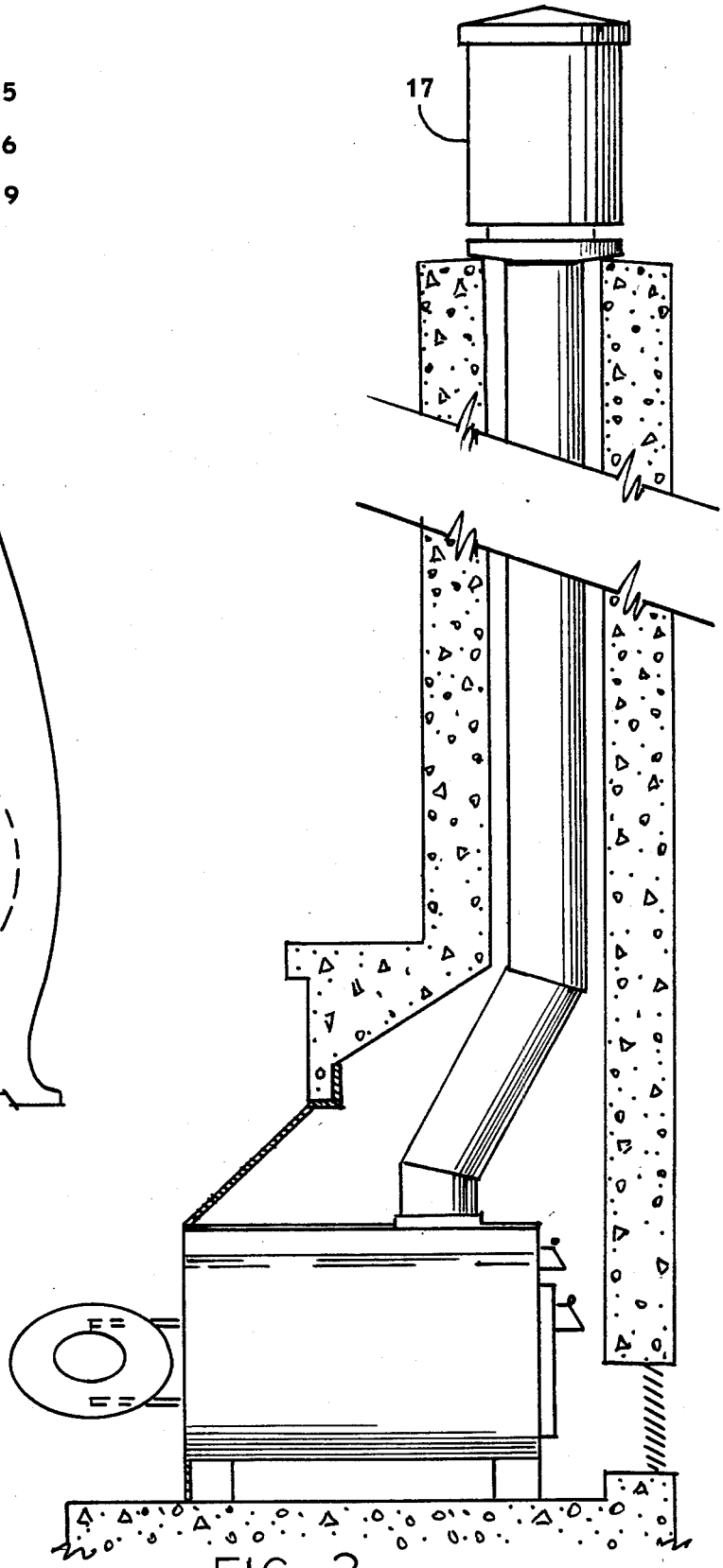
Figure 3:
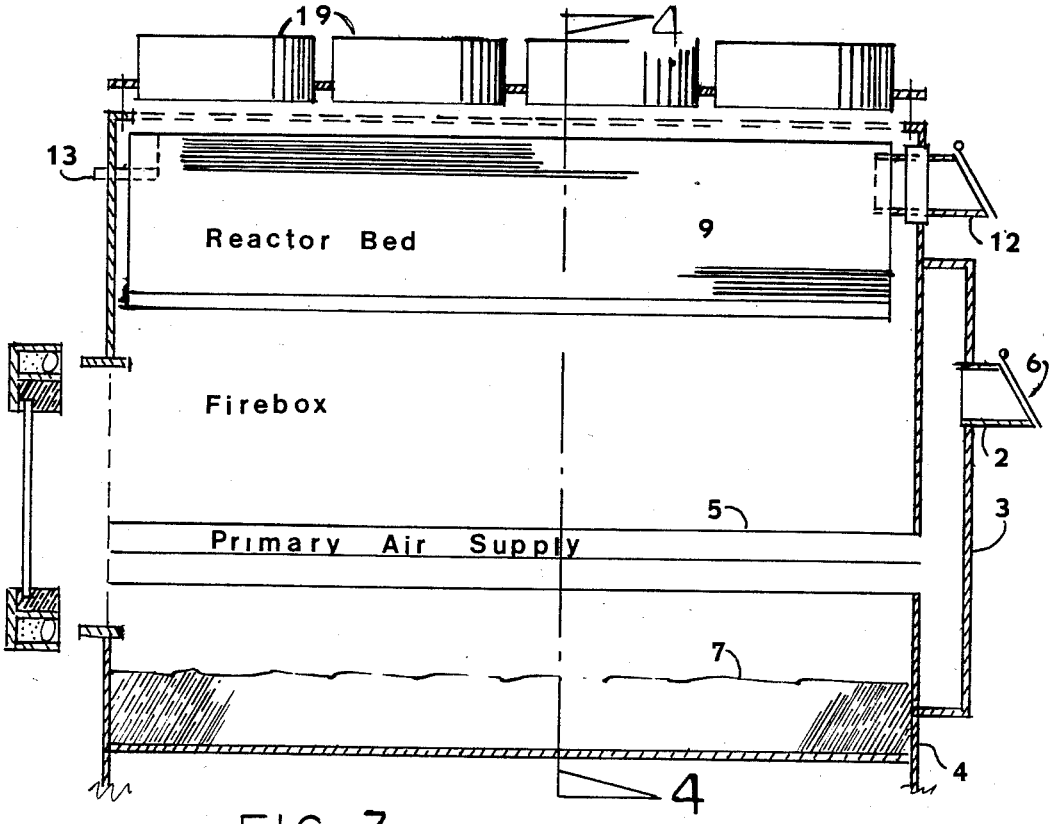
FIG. 3 shows a longitudinal section of the firebox. The bottom is floored with refractory for easy maintenance, as is the firing door and viewing port pulled off at the left side. The right side shows primary air inlet 2 which supplies airbox 3 and then feeds into two angles to deliver thin sheets of air over the entire length of the fire on both sides of the fuel charge. Secondary air is supplied to the inside of a reactor.

At the outset it is in order to discuss radiant heat lest it be assumed that since so little use has been made of it in prior art it is of little consequence. Let's compare firebox walls of 300° F. and 800° F. which we might have if a blower were used to promote more heat from a stove's walls, as against what we might have with a normal fire in an insulated firebox. Add 460 degrees to both these temperatures to bring to absolute temperatures, and when raised to the fourth power the hotter surfaces radiates 7.55 times the heat.

The expression to "see" radiant heat is commonly used and should be given definition. Light and radiant heat are identical in the way they can be reflected and focused. If you are illuminated in the beam of a headlight you see via the reflector, the hot filament. If the light or heat strikes a surface with obliquity as against normally, the radiant heat is inadequately seen.

It is germane to include here the following from Robert B. Leighou, "Chemistry of Engineering Materials" McGraw Hill, 1942, p 64.

> When an air-gas mixture is allowed to impinge upon a heated surface, it is found that combustion proceeds more rapidly on the surface than in the body of the gas. This is known as surface combustion, and the rate at which it proceeds is dependent on the temperature, the extent of the surface, and the speed with which reactants can diffuse to the surface and the products of reaction away from it. If sufficiently hot, all surfaces show about the same effect in catalyzing the combustion reaction. At low temperatures some solids, e.g., platinum and palladium sponge, are better catalysts than others.

In the following description I use dimensions where those could be of use in scaling a firebox up or down so that performance objectives can be reasonably replicated.

Drawing sheet 2 shows a steel drum 1 rolled up to 22" diameter 27" long with a flanged neck 13" wide and 4" high. The primary air inlet 2 is at the back and begins as a 2" to 2¼" inside diameter tube welded to airbox 3 which is 1" deep and stiffens the back end-sheet 4 and also serves to heat the air and feed two angle distribution troughs 5. These are 1½"×1½" located as shown with the upper leg welded continuously and the lower leg gapped 3/16" and the gap maintained by weld tacks.

Figure 4A:
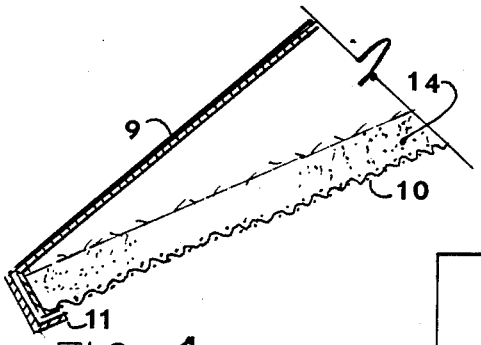
FIG. 4 is a transverse section and shows how secondary air inlet 12 feeds into the inside of the reactor box. For clarity, FIG. 4A omits showing the end sheet carrying the airbox 3 because the profile of this sheet varies with the installation—and plays no part.
Figure 4:
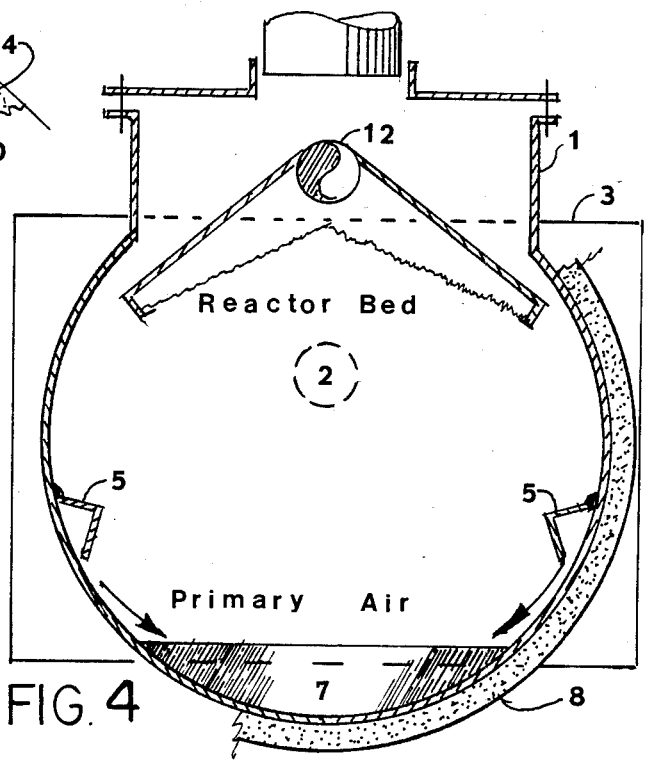
Figure 5:
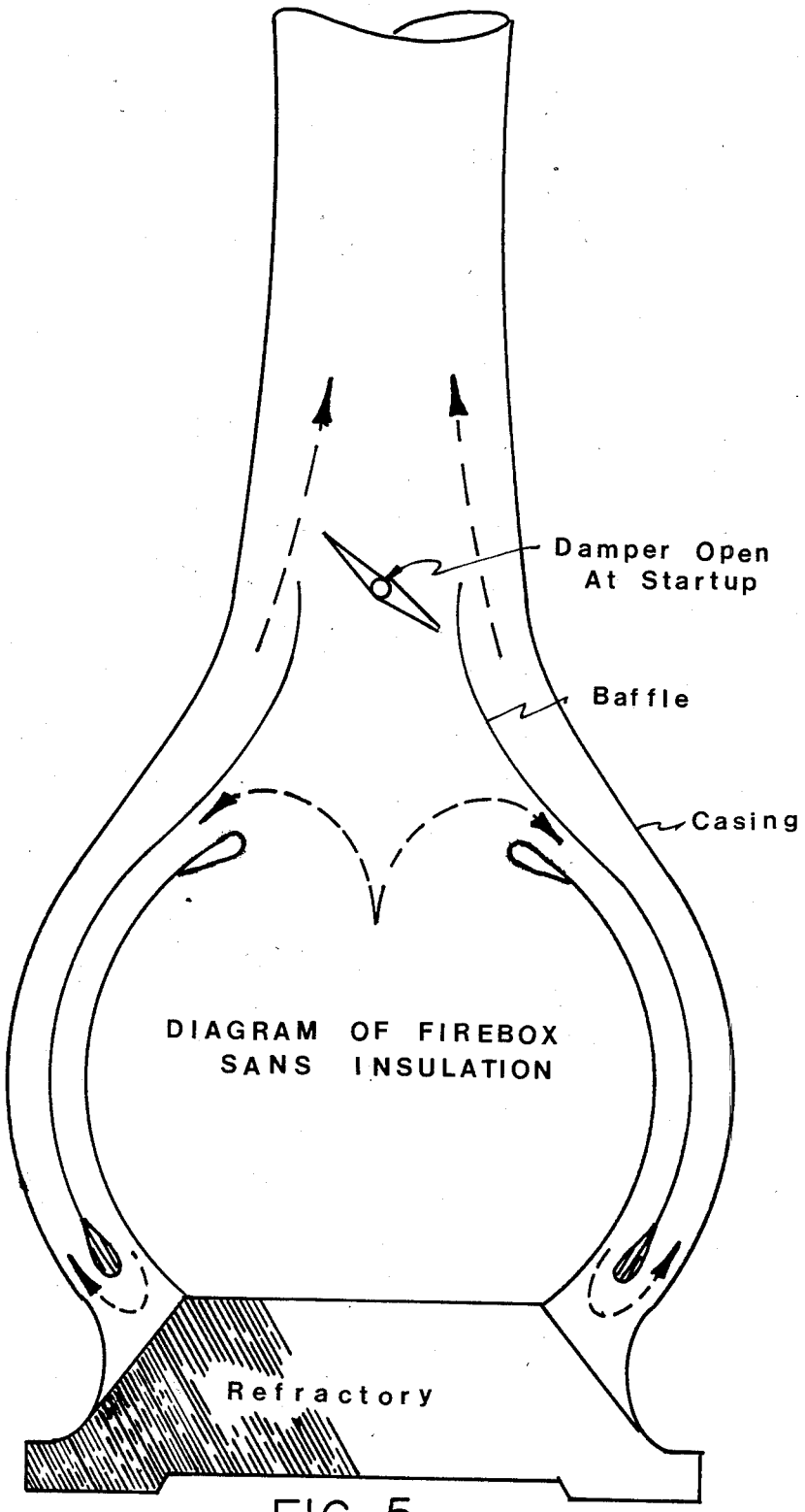
FIG. 5 is a diagram showing a transverse section thru a firebox which illustrates how—in lieu of insulating the firebox wall—waste gases are baffled down and around the firebox. Thus keeping it hot and only then allowed to heat an exterior skin or casing and then sent to stack.

The primary air can be seen on FIG. 4 to feed the fire from two sides in thin sheets the entire length of the firebox (total 54"). With wood necessarily placed axially, good contact and intimate mixing with wood and gases takes place. While the heating of primary air has begun in airbox 3 it is now further effectively heated because thin sheets of air wipe the hot *inner* wall of the firebox. Of course it is well known that transfer from metal surfaces to air is very responsive to air velocities shearing off stagnant laminar air films.

The primary air inlet 2 is provided with a hinged control flap 6 if fed with room air or a butterfly damper where outside air is required to be piped in by local ordinances.

The firebox is provided with a cast-in-situ refractory mix 7 to prevent corrosion and facilitate cleanout. It is brought up to within 1½" of the bottom of the door opening. The firebox exterior is insulated with a 1" layer of ceramic fiber blanket 8 (approximate composition: half aluminum oxide and half silicon dioxide—insulation good for operation at 2300° F.) and held by a thin metal sheet laced on. This insulation on the exterior of the stove is economic, space saving, ensures that it will never crack or be damaged, is of low mass and leaves the interior of the stove to function as a heat receptor/radiator. An alternate to insulating the exterior of the firebox is to route the exiting gases, after they passed the reactor bed, back around the firebox, down to the refractory level. They can then heat a skin which reaches nearly to the ceiling and radiates heat to space. Or gases can route to any other exchanger; or up the stack. This method too would maintain a hot firebox wall.

The reactor box 9 is made entirely of stainless steel, for immunity to scaling. It is welded, with a stainless screen 10 on the bottom face, held in a frame 11 which snaps on the box. This reactor box is also fed with air through the back firebox sheet 4 with a socketed 2" diameter tube 12 providing both the air supply and a rear support. The front of the box is supported by a removeable pin 13 running into a sleeve aligned with the tubular air inlet at the rear. Removing the front pin allows the reactor to be lowered and withdrawn out of the firebox door. It is free to pivot on the front pin 13 and the rear tube 12 (so that cleaning brushes will clear it and shed soot from the back). It fits the front and rear snugly with just enough clearance for removal. The clearance at the edges for passage of the waste gases between the reactor bed and the firebox shell is 1¼" to 1⅜".

The bed material 14 supported by the stainless screen has multiple requirements. It should have low specific heat, be refractory and capable of having its permeability controlled. This permability business needs explanation. Secondary air passing thru the reactor is undesireable under two conditions. When the fire is being started all the air going into the firebox should come from the two distribution troughs 5, because little or no draft exists as yet and another air source would deduct from the prime supply which is breathing life into an infant fire. At low holding fires, when just a bed of coals exists, and no more combustible gases are being liberated, a reactor admitting air would be parasitic, wasteful. At both these conditions natural draft is very low—about 0.01" of water on the inclined manometer.

At the other extreme, with high hot fires, the draft can be 0.1". This varies with different chimney heights, chimney constructions, but is illustrative. We see a draft range of 1 to 10 from a low to high fire condition. If we simply admit air through a port or ports we would admit it in rough accord with the variation in draft—and at high drafts this is too much. To rephrase what has been said before, people cannot be expected to tune the secondary air to the ever-varying fire conditions to optimize operation. Our design efforts should therefore be directed to snub out the air flows at low drafts and delimit flows at high drafts. We do this by grading the bed.

The bed material is coarse ceramic fiber filaments 18 microns dia. which are then handled similarly to the way fiberglass preforms have been made with flock guns. The construction is tailored to pass about 55% of the total air supplied at a high-draft condition. This can be done with the reactor outside the firebox and dismantled so that the reactor screen 10 and frame 11 are separated from the back box 9 and mounted on a temporary plenum. Pull on the plenum with an industrial vacuum, blow the fibers thru a crop duster, and spray with sodium silicate binder as you do so. Whatever size firebox is being fitted should have a desired exchanger and stack and a fire built to high heat.

To check as you go, switch plenum hose from vacuum to socket, which normally receives tube 12, and take an inclined manometer reading in the temporary plenum. This should be nearly the same, slightly less, than the reading at the primary draft inlet. Blow fibers and spray to suit. Now snap the back box on the reactor frame (100 degree angle holds it) and you're done. When the fire is out, install it.

Commercial practice would not repeat this for every like firebox/exchanger because it is amenable to reasonable duplication by procedure and inspection compared to a standard.

What is claimed is:

1. A method for burning solid fuels cleanly comprising the steps of:

shaping the firebox to "see" the radiant heat of the fire for focusing and re-radiating that heat back to the fire;

insulating the exterior of the firebox for the purpose of conserving and raising inner wall temperatures;

feeding primary combustion air successively thru an airbox and then flowing it in thin sheets to wipe the hot inner wall of the firebox, for heating;

impinging that hot primary air the full length and on two sides of the fuel charge for optimal contacting;

conducting flames and gases past the face of a reactor bed for burning there;

admitting secondary air through the reactor for heating and the ignition of gases on its face.

2. A method for burning solid fuels cleanly comprising the steps of:

shaping the firebox to "see" the radiant heat of the fire for focusing and re-radiating that heat back to the fire;

channeling hot waste gases down and wrapping the firebox with them whereby the firebox wall remains hot;

turning the gases up again, running inside a jacket or casing and discharging to atmosphere, whereby the jacket or casing is used to surrender heat to a room;

feeding primary combustion air successively thru an airbox and then flowing it in thin sheets to wipe the hot inner wall of the firebox for heating;

impinging that hot primary air the full length and on two sides of the fuel charge for optimal contacting;

conducting flames and gases past the face of a reactor bed for burning there;

admitting secondary air through the reactor for heating and the ignition of gases on its face.

* * * * *